United States Patent [19]

Goudriaan et al.

[11] 4,126,538

[45] Nov. 21, 1978

[54] PROCESS FOR THE CONVERSION OF HYDROCARBONS

[75] Inventors: Frans Goudriaan; Jakob Van Klinken, both of Amsterdam, Netherlands

[73] Assignee: Shell Oil Company, Houston, Tex.

[21] Appl. No.: 832,250

[22] Filed: Sep. 12, 1977

[30] Foreign Application Priority Data

Sep. 22, 1976 [NL] Netherlands ..... 7610511

[51] Int. Cl.[2] ..... C10G 39/00; C10G 13/06

[52] U.S. Cl. ..... 208/80; 208/59; 208/86; 208/92; 208/108; 208/210; 208/218; 208/251 H

[58] Field of Search ..... 208/80, 86, 89, 56–59, 208/210, 218, 251 H

[56] References Cited

U.S. PATENT DOCUMENTS

| | | | |
|---|---|---|---|
| 2,801,208 | 7/1957 | Horne et al. | 208/61 |
| 2,914,470 | 11/1959 | Johnson et al. | 208/264 |
| 3,175,966 | 3/1965 | Burch | 208/79 |
| 3,245,900 | 4/1966 | Paterson | 208/56 |
| 3,287,254 | 11/1966 | Paterson | 208/68 |
| 3,394,077 | 7/1968 | Kovach et al. | 208/216 |
| 3,775,292 | 11/1973 | Watkins | 208/86 |
| 4,062,758 | 12/1977 | Goudriaan et al. | 208/80 |

*Primary Examiner*—Delbert E. Gantz
*Assistant Examiner*—G. E. Schmitkons
*Attorney, Agent, or Firm*—Ronald R. Reper

[57] ABSTRACT

Residual hydrocarbon stocks obtained after vacuum distillation are converted into light distillates by certain sequences of processing steps including vacuum distillation, deasphalting, hydrocracking, atmospheric distillation and catalytic hydrotreating.

8 Claims, 2 Drawing Figures

PROCESS FOR THE CONVERSION OF HYDROCARBONS

BACKGROUND OF THE INVENTION

The invention relates to a process for the preparation of one or more atmospheric hydrocarbon oil distillates from a hydrocarbon oil residue obtained by vacuum distillation.

In the atmospheric distillation of crude mineral oil, as applied on a large scale in refineries for the preparation of atmospheric distillates, a residual oil is obtained as a by-product. To increase the yield of atmospheric distillates from the crude oil concerned, a vacuum distillate can be separated from the said residual oil by vacuum distillation, which vacuum distillate can be converted in a relatively simple way, for instance by catalytic cracking or hydrocracking, into one or more atmospheric distillates. Just as in atmospheric distillation, a residual oil is obtained as a by-product in vacuum distillation. In some cases this residual oil, which as a rule contains considerable quantities of sulphur, metals and asphaltenes, is only suitable for use as a fuel oil component.

In view of the increasing demand for atmospheric distillates, attempts were made in the past to convert the vacuum residues into atmospheric distillates, for instance by catalytic cracking or hydrocracking. The use of the vacuum residues as such as the feed for these processes has serious drawbacks which preclude their application on a commercial scale. Thus, major drawbacks of, for instance, catalytic cracking of the vacuum residues are that it entails very high catalyst consumption and that because of the very high coke and gas production only a low yield of the desired atmospheric distillates is obtained. Hydrocracking of the vacuum residues involves a rapid catalyst deactivation, a high gas production and a high hydrogen consumption.

To increase the yield of atmospheric hydrocarbon oil distillates from the crude oil concerned, one might consider deasphalting the vacuum residues mentioned so as to separate a deasphalted oil, which may be converted, for instance by catalytic cracking or hydrocracking, into one or more atmospheric hydrocarbon oil distillates. A drawback of this route is, however, that deasphalting of the vacuum residues yields asphalt as a by-product. Apart from its use for engineering purposes, for instance in road-building and as a component for refinery fuel, this material has only limited applicability. Conversion of the asphalt into atmospheric distillates via the above-mentioned catalytic cracking or hydrocracking processes cannot be considered in view of its very high metal and asphaltenes content. Application of other conversion processes such as coking, thermal cracking and gasification in combination with hydrocarbon synthesis is rather unattractive in view of the low yield of the atmospheric distillates mentioned and/or the high costs involved in the process.

In view of the above and considering the fact that in the processing of crude mineral oil into atmospheric distillates via atmospheric distillation, vacuum distillation combined with conversion of the vacuum distillate and deasphalting combined with conversion of the deasphalted oil, considerable quantities of asphalt are obtained as by-product, it will be clear that there is an urgent need for a process which offers the possibility of converting this asphalt in an economically justifiable way into atmospheric distillates such as gasolines.

Since catalytic cracking and hydrocracking have proved in practice to be excellent processes for the conversion of vacuum distillates such as vacuum gas oils into atmospheric distillates such as gasolines, the applicant has carried out an investigation to find out to what extent these processes can be utilized in the conversion of the above-mentioned asphalt. It has been found that a certain combination of catalytic cracking and/or hydrocracking with a catalytic hydrotreatment and deasphalting, a process can be realized that is highly suitable for this purpose. The present patent application relates to such a process.

SUMMARY OF THE INVENTION

According to the invention, there is provided a process for the production of at least one atmospheric hydrocarbon oil distillate from a hydrocarbon oil residue obtained by atmospheric distillation which comprises (a) fractionating said residue by vacuum distillation into a vacuum distillate and a vacuum residue having an initial atmospheric boiling point above 500° C., (b) deasphalting said vacuum residue in a deasphalting zone by contact with a lower hydrocarbon sorbent to obtain a deasphalted oil which is passed to step (c) and asphalt, which is passed to step (e), (c) cracking said vacuum distillate and said deasphalted oil in a cracking zone comprising either a catalytic cracking zone or a hydrocracking zone to obtain a cracked product, (d) fractionating said cracked product by fractionation distillation at essentially atmospheric pressure to obtain at least one light hydrocarbon distillate product, and residue, and recycling at least part of this cracked product as feed to the cracking zone, (e) hydrotreating said asphalt in a catalytic hydrotreating zone under such conditions that more than 50% by weight of the feed is converted into material which does not precipitate in a deasphalting step under the same conditions used to prepare said asphalt feed, to obtain a hydrotreated asphalt product, (f) fractionating said hydrotreated asphalt product by fractionation distillation at essentially atmospheric pressure to obtain at least one hydrotreated atmospheric distillate product and a hydrotreated atmospheric residue, (g) fractionating said hydrotreated atmospheric residue from step (f) by vacuum distillation into a hydrotreated vacuum distillate and a hydrotreated vacuum residue and recycling at least part of this hydrotreated vacuum residue to the deasphalting zone of step (b).

DESCRIPTION OF PREFERRED EMBODIMENTS

Figure 1:
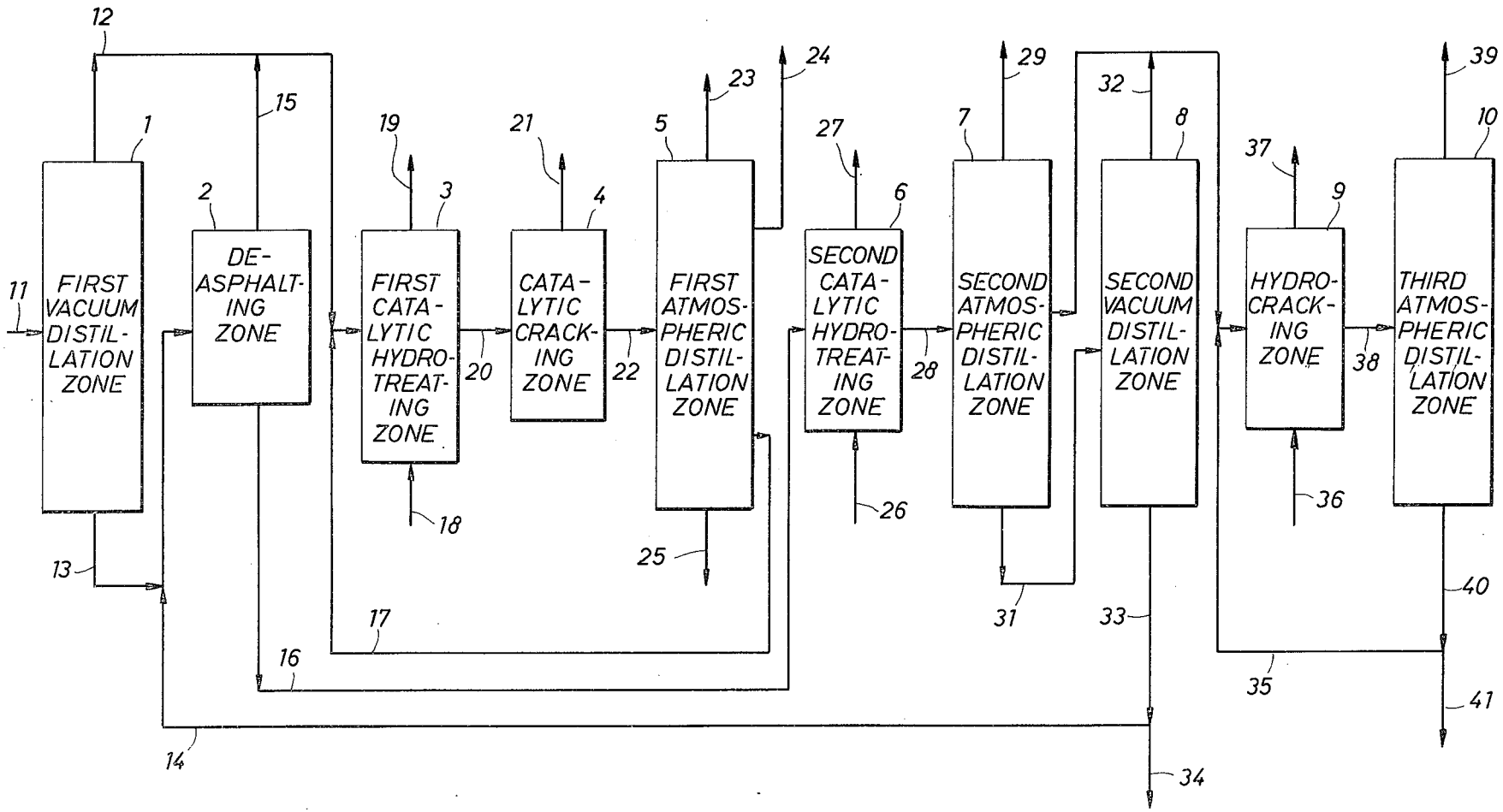
FIGS. 1 and 2 each illustrate different embodiments of the processing scheme according to the invention.

In the process according to the invention a hydrocarbon oil residue obtained by vacuum distillation and having an initial boiling point above 500° C. is separated by $C_4^+$ deasphalting into a deasphalted oil, which is subsequently catalytically cracked or hydrocracked, and into a $C_4^+$ asphalt. The $C_4^+$ asphalt is subjected to a catalytic hydrotreatment under such conditions that more than 50%w of the feed for the catalytic hydrotreatment is converted into a material which does not precipitate in a $C_4^+$ deasphalting process effected under the same conditions as the deasphalting of the vacuum residue. The hydrotreated product is separated by distillation into one or more atmospheric distillates, a vacuum distillate and a vacuum residue having an initial boiling point above 500° C. The vacuum distillate of the hydrotreated product is converted by catalytic cracking or hydrocracking into one or more atmospheric distillates, and at least 50%w of the vacuum residue of the hydrotreated product is again subjected to the $C_4^+$ deasphalting. In this patent application $C_4^+$ deasphalting should be taken to mean deasphalting with the aid of a lower hydrocarbon or a mixture of lower hydrocarbons having at least four carbon atoms per molecule, such as butane, pentane or a mixture of butane and pentane as the solvent.

The process according to the invention comprises catalytic cracking and/or hydrocracking of a vacuum distillate and a deasphalted oil as the main operation(s). In these operations a considerable proportion of the feed concerned is converted into the said atmospheric distillates. One or more atmospheric distillates are separated as end products from the cracked product by distillation. To increase the yield of atmospheric distillates it is preferred to recycle at least part of the atmospheric residue obtained in the distillation of the cracked product to the catalytic cracker or hydrocracker. If the process according to the invention comprises catalytic cracking as one of the main operations and, in addition, at least part of the aforementioned atmospheric residue is recycled to the catalytic cracking unit and/or a deasphalted oil is used as the feed for the catalytic cracking unit, these liquids are preferably given a light catalytic hydrotreatment before they are subjected to catalytic cracking. In the catalytic cracking process, which is preferably carried out in the presence of a zeolitic catalyst, coke is deposited on the catalyst. This coke is removed from the catalyst by burning-off during a catalyst regeneration step that is combined with the catalytic cracking, whereby a waste gas is obtained which contains carbon monoxide and carbon dioxide. Catalytic cracking is preferably carried out at an average temperature in the range from about 400 to 550° C. and particularly from about 450 to 525° C., a pressure in the range from about 1 to 10 bar and particularly from about 1.5 to 7.5 bar, a space velocity in the range from about 0.25 to 4 $kg.kg^{-1}.h^{-1}$ and particularly from about 0.5 to 2.5 $kg.kg^{-1}.h^{-1}$ and a rate of catalyst replenishment in the range from about 0.1 to 5 and particularly from about 0.2 to 2 tonnes of catalyst per 1000 tonnes of feed.

The process according to the invention may comprise hydrocracking as one of the main operations. Hydrocracking is effected by contacting the feed at elevated temperature and pressure and in the presence of hydrogen with a suitable hydrocracking catalyst. Hydrocracking is preferably carried out as a two-stage process, in which the hydrocracking proper, which is effected in the second stage, is preceded by a catalytic hydrotreatment which serves mainly to reduce the nitrogen and polyaromatics contents of the feed in the first stage. Catalysts suitable for use in the single stage hydrocracking process as well as in the second stage of the two-stage hydrocracking process are moderately and strongly acidic catalysts comprising one or more metals having hydrogenation activity on a carrier. Hydrocracking is preferably carried out at an average temperature in the range from about 250 to 450° C. and particularly from about 300 to 425° C., a hydrogen partial pressure in the range from about 25 to 300 bar and particularly from about 50 to 150 bar, a space velocity in the range from about 0.1 to 10 $kg.l^{-1}.h^{-1}$ and particularly from about 0.25 to 2 $kg.l^{-1}.h^{-1}$ and a hydrogen-to-feed ratio in the range from about 200 to 3000 $Nl.kg^{-1}$ and particularly from about 500 to 2000 $Nl.kg^{-1}$. If the hydrocracking is carried out according to the two-stage process it is preferred to use the whole reaction product from the first stage (without ammonia, hydrogen sulphide or other volatile components being separated from it) as the feed for the second stage.

The process according to the invention comprises $C_4^+$ deasphalting of the vacuum residue feed for the process. The deasphalting is preferably carried out at elevated temperature and pressure and in the presence of an excess of butane as the solvent.

The process according to the invention further comprises catalytic hydrotreatment of the $C_4$ asphalt. This catalytic hydrotreatment has to be carried out under such conditions that more than 50% w of the feed for the catalytic hydrotreatment is converted into material which does not precipitate in a $C_4^+$ deasphalting step effected under the same conditions as the deasphalting of the vacuum residue. This catalytic hydrotreatment is preferably carried out as a two-stage process, in which the conversion proper of asphalt, which conversion is effected in the second stage, is preceded by a catalytic hydrotreatment intended mainly to reduce the metal content of the feed to be converted. Catalysts suitable for use in the one-stage catalytic hydrotreatment as well as in the second stage of the two-stage catalytic hydrotreatment comprise one or more metals having hydrogenation activity on a carrier, which carrier consists of more than 40%w alumina. Catalysts suitable for use in the first stage of the two-stage catalytic hydrotreatment consist of more than 80%w silica. The catalytic hydrotreatment is preferably carried out at an average temperature in the range from about 375 to 475° C. and particularly from about 390 to 450° C., a hydrogen partial pressure in the range from about 25 to 300 bar and particularly from about 50 to 200 bar, a space velocity in the range from about 0.1 to 1.5 $kg.l^{-1}.h^{-1}$ and particularly from about 0.2 to 1.0 $kg.l^{-1}.h^{-1}$ and a hydrogen-to-feed ratio in the range from about 250 to 2500 $Nl.kg^{-1}$ and particularly from about 500 to 2000 $Nl.kg^{-1}$. If the catalytic hydrotreatment is carried out in two stages, the first stage is preferably effected in the presence of a quantity of $H_2S$ corresponding to an $H_2S$ content of the gas at the reactor inlet of more than 10%v and the second stage in the presence of a quantity of $H_2S$ corresponding to an $H_2S$ content of the gas at the reactor inlet of less than 5%v.

As previously stated, the catalytic hydrotreatment according to the invention has to be carried out under such conditions that more than 50% w of the feed for the catalytic hydrotreatment is converted into products which do not precipitate in a $C_4^+$ deasphalting effected under the same conditions as the deasphalting of the vacuum residue. Among these products are atmospheric distillates which are suitable as end products.

In the process according to the invention two streams are obtained which have to be subjected to catalytic cracking or hydrocracking, viz. a deasphalted oil and a vacuum distillate. For the conversion of the two streams preference is given to the same treatment and to treatment in one unit.

The process according to the invention is very suitable for use as part of a more extensive process for the preparation of atmospheric hydrocarbon oil distillates from atmospheric hydrocarbon oil residues. Such processes may be carried out as follows. An atmospheric distillate oil residue is separated by vacuum distillation into a vacuum distillate and a vacuum residue having an initial boiling point above 500° C. The desired atmospheric hydrocarbon oil distillates are prepared from the vacuum distillate by catalytic cracking or hydrocracking and from the vacuum residue according to the invention. In the preparation of atmospheric distillates from atmospheric residues, three streams are obtained which have to be subjected to catalytic cracking or hydrocracking, viz. a deasphalted oil and two vacuum distillates. The conversion of these three streams is preferably effected by the same treatment and in one unit. If the preparation of atmospheric distillates from atmospheric residues comprises catalytic cracking of the vacuum distillate from the atmospheric residue used as the starting material, this vacuum distillate is preferably subjected first to a light catalytic hydrotreatment. Just as the light catalytic hydrotreatment mentioned hereinbofore, which is preferably applied to the part of the catalytically cracked product to be recycled, if necessary, to the catalytic cracking product to be recycled, if necessary, to the catalytic cracking unit and/or to the deasphalted oil to be used, if necessary, as the feed for the catalytic cracking unit, this treatment is primarily meant to reduce the metal content of the feed and thereby restrict the catalyst consumption in the cracking unit and is further aimed at saturating the feed for the catalytic cracking unit with hydrogen and thereby decreasing carbon deposition on the cracking catalyst and raising the yield of the desired product. The light catalytic hydrotreatment of the residue to be recycled to the catalytic cracking unit and/or that of the deasphalted oil to be used as the feed for the catalytic cracking unit, as well as the catalytic hydrotreatment of the vacuum distillate from the atmospheric residue used as the starting material are preferably carried out in the same unit.

In the process according to the invention at least 50%w of the vacuum residue of the hydrotreated product has to be subjected again to the $C_4^+$ deasphalting. If it is desired in the preparation of atmospheric distillates from atmospheric residues to use the same operation both for the conversion of the vacuum distillate from the atmospheric residue used as the starting material and for the conversion of the vacuum distillate from the hydrotreated product, i.e. either catalytic cracking or hydrocracking, than the process according to the invention can be effected with only one vacuum distillation section, by using the vacuum distillation section in which the atmospheric residue that is used as the starting material is separated into a vacuum distillate and a vacuum residue also for separating an atmospheric residue of the hydrotreated product.

The process according to the invention is suitable both for the preparation of exclusively one or more light distillates as the end products and for the preparation of one or more light distillates together with one or more middle distillates as end products. If the aim is to prepare exclusively one or more light distillates as end products, a middle distillate to be separated from the cracked product and having an initial boiling point above the final boiling point of the heaviest light distillate may be recycled for repeated cracking. In that case, besides the vacuum distillate of the hydrotreated product, a middle distillate to be separated from the hydrotreated product and having an initial boiling point above the final boiling point of the heaviest light distillate desired may also be recycled for use as feed component for the catalytic cracking or hydrocracking to be carried out as the main operation.

Two process schemes for the conversion of atmospheric hydrocarbon oil residues into light and medium hydrocarbon oil distillates will be elucidated hereinafter in more detail by reference to the following drawings.

PROCESS SCHEME I (FIG. 1)

The process is carried out in an apparatus comprising successively the first vacuum distillation zone 1, a $C_4^+$ deasphalting zone 2, the first catalytic hydrotreating zone 3, a catalytic cracking zone 4, the first atmospheric distillation zone 5, the second catalytic hydrotreating zone 6, the second atmospheric distillation zone 7, the second vacuum distillation zone 8, a hydrocracking zone 9 and the third atmospheric distillation zone 10. A hydrocarbon oil residue 11 obtained by atmospheric distillation is separated by vacuum distillation into a vacuum distillate 12 and a vacuum residue 13. The vacuum residue 13 is mixed with a vacuum residue 14 and the mixture is separated by $C_{4+}$ deasphalting into a deasphalted oil 15 and an asphalt 16. The vacuum distillate 12, the deasphalted oil 15 and a middle distillate fraction 17 are mixed and the mixture, together with a hydrogen stream 18, is subjected to a catalytic hydrotreatment. After separation of a gas stream 19, substantially consisting of $C_{4-}$ hydrocarbons and $H_2S$, from the hydrotreated product, the liquid reaction product 20 is catalytically cracked in catalytic cracking zone 4. The regeneration of the catalyst in the catalytic cracking unit yields a waste gas 21 containing carbon monoxide and carbon dioxide. The catalytically cracked product 22 is separated by atmospheric distillation into a $C_{4-}$ fraction 23, a gasoline fraction 24, a middle distillate fraction 17 and a residue 25 being a mixture of heavy cycle oil and slurry oil. The asphalt 16, together with a hydrogen stream 26, is subjected to a catalytic hydrotreatment. After separation of a gas stream 27, substantially consisting of $C_{4-}$ hydrocarbons and $H_2S$, from the hydrotreated product, the liquid reaction product 28 is separated by atmospheric distillation into a gasoline fraction 29, a middle distillate fraction 30 and a residue 31. The residue 31 is separated by vacuum distillation into a vacuum distillate 32 and a vacuum residue 33. The vacuum residue 33 is separated into two portions 14 and 34 having the same composition. The middle distillate fraction 30 is mixed with the vacuum distillate 32 and with an atmospheric residue 35, and the mixture, together with a hydrogen stream 36, is hydrocracked. After separation of a gas stream 37, substantially consisting of $C_{4-}$ hydrocarbons, from the cracked product, the liquid reaction product 38 is separated by atmospheric distillation into a gasoline fraction 39 and a residue 40. The residue 40 is divided into two portions 35 and 41 having the same composition.

PROCESS SCHEME II (FIG. 2)

The process is carried out in an apparatus comprising successively a vacuum distillation zone 51, a deasphalting zone 52, a hydrocracking zone 53, the first atmospheric distillation zone 54, a catalytic hydrotreating zone 55 and the second atmospheric distillation zone 56. A hydrocarbon oil residue 57 obtained by atmospheric distillation is mixed with an atmospheric residue 58 and the mixture is separated by vacuum distillation into a vacuum distillate 59 and a vacuum residue 60. The vacuum residue 60 is separated by deasphalting into a deasphalted oil 61 and an asphalt 62. The vacuum distillate 59 is mixed with the deasphalted oil 61 and with an atmospheric residue 63, and the mixture, together with a hydrogen stream 64 is hydrocracked. After separation of a gas stream 65, substantially consisting of $C_4$_ hydrocarbons and $H_2S$, from the cracked product, the liquid reaction product 66 is separated by atmospheric distillation into a gasoline fraction 67, a middle distillate fraction 68 and a residue 63. The asphalt 62, together with a hydrogen stream 69, is subjected to a catalytic hydrotreatment. After separation of a gas stream 70, substantially consisting of $C_4$_ hydrocarbons and $H_2S$, from the hydrotreated product, the liquid reaction product 71 is separated by atmospheric distillation into a gasoline fraction 74, a middle distillate 75 and a residue 76. The residue 76 is divided into two portions 58 and 77 having the same composition.

Figure 2:
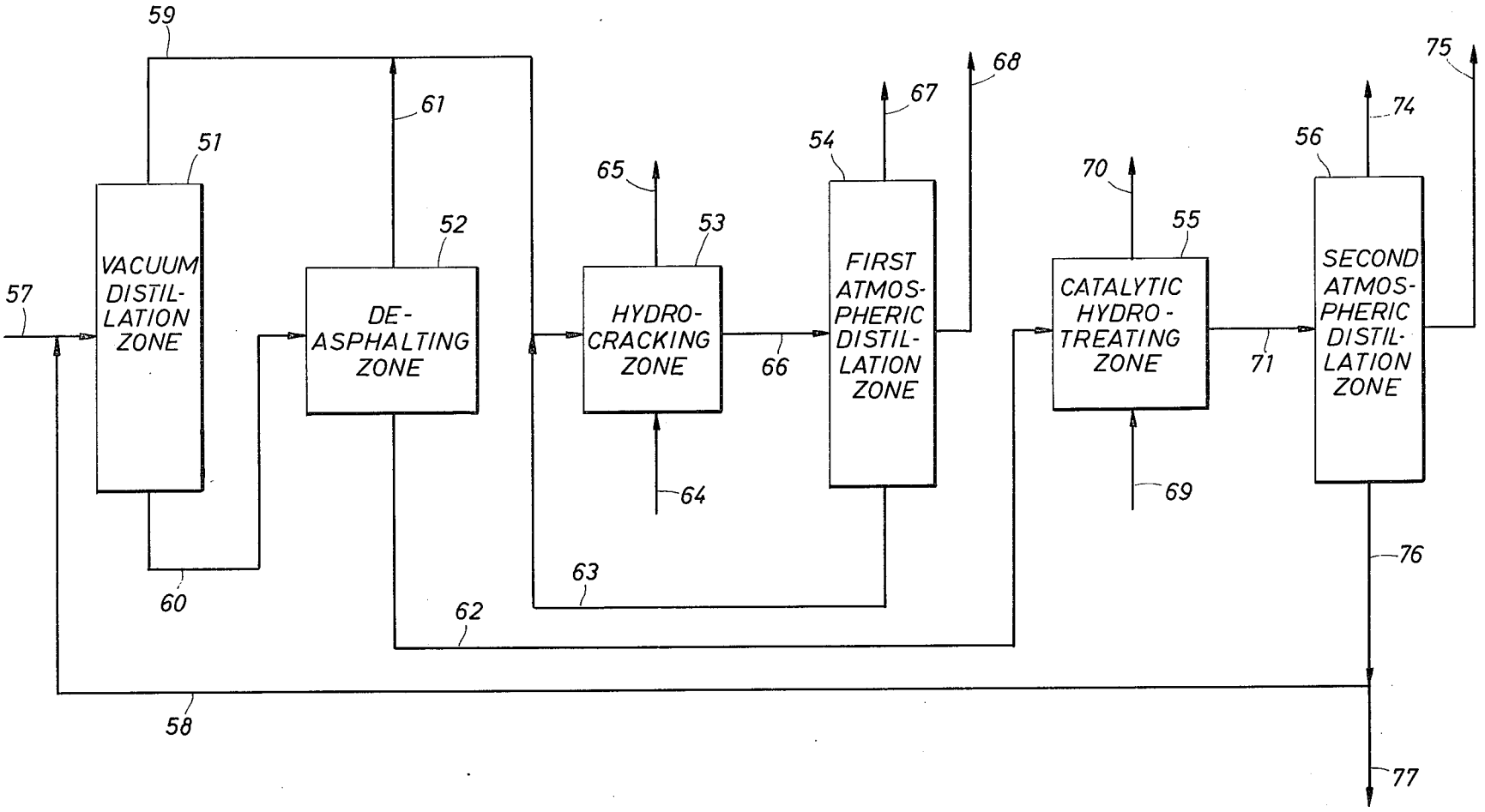

The present patent application also comprises apparatus for carrying out the process according to the invention as schematically shown in FIGS. 1 and 2.

The invention will now be elucidated by reference to the following examples.

The process according to the invention was applied to an atmospheric distillation residue of a crude oil from the Middle East. The atmospheric distillation residue had an initial boiling point of 370° C. By vacuum distillation of 100 pbw of the atmospheric residue, 44 pbw of a 520° C.+ vacuum residue could be separated from it; by deasphalting these 44 pbw vacuum residue at 145° C. and 41 bar with butane as the solvent and a solvent-to-oil weight ratio of 4:1, 21 pbw of $C_4$ asphalt could be obtained from it. The process was carried out according to process schemes I and II. The following conditions were used in the various sections.

In both process schemes hydrocracking was carried out in two stages, and the whole reaction product from the first stage was used as the feed for the second stage; part of the cracked product was recycled to the first stage. In both schemes a sulphided $Ni/Mo/F/Al_2O_3$ catalyst comprising 5 pbw nickel, 20 pbw molybendum and 15 pbw fluorine per 100 pbw alumina was used for the first stage of hydrocracking and a sulphided Ni/W/F/faujasite catalyst comprising 3 pbw nickel, 10 pbw tungsten and 5 pbw fluorine per 100 pbw faujasite for the second stage. Both stages of the hydrocracking were carried out under the conditions given in Table A.

Table A

| | uz,12/21 I | | II | |
|---|---|---|---|---|
| Scheme No. | 1st stage | 2nd stage | 1st stage | 2nd stage |
| Average temp., ° C | 375 | 366 | 390 | 375 |
| $P_{H_2}$, bar | 120 | 115 | 120 | 115 |
| Space velocity, $kg.l^{-1}.h^{-1}$ | 1.0 | 1.0 | 0.8 | 0.8 |
| $H_2$/feed ratio, $Nl.kg^{-1}$ | 1000 | 1500 | 1000 | 1500 |

In both process schemes the catalytic hydrotreatment was conducted in two stages in the presence of an $Ni/V/SiO_2$ catalyst comprising 0.5 pbw nickel and 2 pbw vanadium per 100 pbw silica in the first stage and an $Ni/Mo/Al_2O_3$ catalyst comprising 4 pbw nickel and 11 pbw molybdenum per 100 pbw alumina in the second stage. Both stages of the catalytic hydrotreatment were carried out under the conditions given in Table B.

Table B

| | I | | II | |
|---|---|---|---|---|
| Scheme No. | 1st stage | 2nd stage | 1st stage | 2nd stage |
| Average temp., ° C | 420 | 424 | 415 | 421 |
| $P_{H_2}$, bar | 150 | 150 | 150 | 150 |
| Space velocity, $kg.l^{-1}.h^{-1}$ | 0.40 | 0.35 | 0.45 | 0.35 |
| $H_2$/feed ratio, $Nl.kg^{-1}$ | 1000 | 1500 | 1000 | 1500 |

In both process schemes the deasphalting was carried out at 145° C. and 41 bar with butane as the solvent and at a solvent-to-oil weight ratio of 4:1.

The catalytic cracking included in process scheme I was carried out at a temperature of 490° C., a pressure of 2.2 bar, a space velocity of 2 $kg.kg^{-1}.h^{-1}$ and a rate of catalyst replenishment of 0.75 tonne of catalyst per 1000 tonnes of oil and in presence of a zeolitic catalyst.

The light catalytic hydrotreatment of the feed for the catalytic cracking unit included in process scheme I was conducted at an average temperature of 380° C., a hydrogen partial pressure of 35 bar, a space velocity of 0.5 $l.l^{-1}.h^{-1}$ and a hydrogen-to-oil ratio of 1000 $Nl.kg^{-1}$ and in presence of a nickel-molybdenum catalyst on alumina as the carrier.

EXAMPLE I

This example was carried out according to process scheme I. With 100 pbw of the 370° C.+ atmospheric distillation residue 11 as the starting material, the following quantities of the various streams were obtained:

56.0 pbw 370–520° C. vacuum distillation 12,
44.0 pbw 520° C.+ vacuum residue 13,
29.0 pbw deasphalted oil 15,
28.1 pbw asphalt 16,
0.8 pbw hydrogen 18,
3.2 pbw $C_4^-$ fraction + $H_2S$ 19,
18.5 pbw $C_4^-$ fraction 23,
48.8 pbw $C_5$—200° C. gasoline fraction 24,
13.2 pbw 200–370° C. middle distillate fraction 17,
9.5 pbw residue 25,
0.9 pbw hydrogen 26,
3.6 pbw $C_4^-$ fraction + $H_2S$ 27,
25.4 pbw liquid product 28,
1.3 pbw $C_5$—200° C. gasoline fraction 29,
4.1 pbw 200–370° C. middle distillate fraction 30,
20.0 pbw 370° C.+ residue 31,
5.4 pbw 370–520° C. vacuum distillate 32,
14.6 pbw 520° C.+ vacuum residue 33,
13.1 pbw portion 14,
1.5 pbw portion 34,
0.3 pbw hydrogen 36,
0.7 pbw $C_4^-$ fraction 37,
9.0 pbw $C_5$—200° C. gasoline fraction 39,
2.3 pbw 200° C.+ residue 40,
2.2 pbw portion 35, and
0.1 pbw portion 41,

EXAMPLE II

This example was carried out according to process scheme II. With 100 pbw of the 370° C.+ atmospheric distillation residue 57 as the starting material, the following quantities of the various streams were obtained:

61.2 pbw 370–520° C. vacuum distillate 59,
61.7 pbw 520° C.+ vacuum residue 60,
31.6 pbw deasphalted oil 61,
30.1 pbw asphalt 62,
3.6 pbw hydrogen 64, 8.4 pbw $C_4^-$ fraction + $H_2S$ 65,
54.2 pbw $C_5$–200° C. gasoline fraction 67,
33.8 pbw 200–370° C. middle distillate fraction 68,
27.7 pbw 370° C.$^+$ residue 63,
0.9 pbw hydrogen 69,
3.9 pbw $C_4^-$ fraction + $H_2S$ 70,
27.1 pbw liquid product 71,
0.6 pbw $C_5$–200° C. gasoline fraction 74,
2.4 pbw 200–370° C. middle distillate fraction 75,
24.1 pbw 370° C.$^+$ residue 76,
22.9 pbw portion 58, and
1.2 pbw portion 77.

What is claimed is:

1. A process for the production of at least one atmospheric hydrocarbon oil distillate from a hydrocarbon oil residue obtained by atmospheric distillation which comprises (a) fractionating said residue by vacuum distillation into a vacuum distillate and a vacuum residue having an initial atmospheric boiling point above 500° C., (b) deasphalting said vacuum residue in a deasphalting zone by contact with a lower hydrocarbon sorbent to obtain a deasphalted oil which is passed to step (c) and asphalt, which is passed to step (e), (c) cracking said vacuum distillate and said deasphalted oil in a cracking zone selected from a catalytic cracking zone and a hydrocracking zone to obtain a cracked product, (d) fractionating said cracked product by fractionation distillation at essentially atmospheric pressure to obtain at least one light hydrocarbon distillate product, and residue, and recycling at least part of this cracked product as feed to the cracking zone, (e) hydrotreating said asphalt in a catalytic hydrotreating zone under such conditions that more than 50% by weight of the feed is converted into material which does not precipitate in a deasphalting step under the same conditions used to prepare said asphalt feed, to obtain a hydrotreated asphalt product, (f) fractionating said hydrotreated asphalt product by fractionation distillation at essentially atmospheric pressure to obtain at least one hydrotreated atmospheric distillate product and a hydrotreated atmospheric residue, (g) fractionating said hydrotreated atmospheric residue from step (f) by vacuum distillation into a hydrotreated vacuum distillate and a hydrotreated vacuum residue and recycling at least part of this hydrotreated vacuum residue to the deasphalting zone of step (b).

2. A process according to claim 1 wherein in step (e) the catalytic hydrotreatment is carried out as a two-stage process and that the first stage is effected in the presence of a quantity of $H_2S$ corresponding to an $H_2S$ content of the gas consisting essentially of $H_2$, $C_4$– hydrocarbon and $H_2S$ at the reactor inlet of more than 10%v and the second stage in the presence of a quantity of $H_2S$ corresponding to an $H_2S$ content of the gas consisting essentially of $H_2$, $C_4$– hydrocarbons and $H_2S$ at the reactor inlet of less than 5%v.

3. A process according to claim 1 wherein in step (c) catalytic cracking is carried out at an average temperature in the range from about 400 to 550° C., a pressure in the range from about 1 to 10 bar, a space velocity in the range from about 0.25 to 4 $kg.kg^{-1}.h^{-1}$ and a rate of catalyst replenishment in the range from about 0.1 to 5 tonnes of catalyst per 1000 tonnes of feed.

4. A process according to claim 1 wherein in step (c) hydrocracking is carried out as a two-stage process in the presence of a weakly or moderately acidic catalyst comprising one or more metals having hydrogenation activity on a carrier in the first stage and a moderately or strongly acidic catalyst comprising one or more metals having hydrogenation activity on a carrier in the second stage.

5. A process according to claim 1 wherein in step (c) hydrocracking is carried out as a two-stage process and that the whole reaction product from the first stage is used as the feed for the second stage.

6. A process according to claim 1 wherein in step (c) hydrocracking is carried out at an average temperature in the range from about 250 to 450° C., a hydrogen partial pressure in the range from about 25 to 300 bar, a space velocity in the range from about 0.1 to 10 $kg.l^{-1}.h^{-1}$ and a hydrogen-to-feed ratio in the range from about 200 to 3000 $Nl.kg^{-1}$.

7. A process according to claim 1 wherein in step (e) the catalytic hydrotreatment is carried out as a two-stage process in the presence of a catalyst consisting of more than 80%w silica in the first stage and a catalyst comprising one or more metals having hydrogenation activity on a carrier, which carrier consists of more than 40%w alumina, in the second stage.

8. A process according to claim 1 wherein in step (e) the catalytic hydrotreatment is carried out at an average temperature in the range from about 375 to 475° C., a hydrogen partial pressure in the range from about 25 to 300 bar, a space velocity in the range from about 0.1 to 1.5 $kg.l^{-1}.h^{-1}$ and a hydrogen-to-feed ratio in the range from about 250 to 2500 $Nl.kg^{-1}$.

* * * * *

UNITED STATES PATENT OFFICE

CERTIFICATE OF CORRECTION

Patent No. 4,126,538 Dated November 21, 1978

Inventor(s) Frans Goudriaan et al.

It is certified that error appears in the above-identified patent and that said Letters Patent are hereby corrected as shown below:

The term of this patent subsequent to December 13, 1994, has been disclaimed.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*